US005943069A

United States Patent [19]

Kamiyama et al.

[11] Patent Number: 5,943,069

[45] Date of Patent: Aug. 24, 1999

[54] INK JET RECORDING HEAD AND APPARATUS IN WHICH RECORDING IS CONTROLLED IN ACCORDANCE WITH CALCULATIONS INVOLVING A MEASURED RESISTANCE

[75] Inventors: Yuji Kamiyama, Fujisawa; Masaaki Izumida, Kawasaki, both of Japan

[73] Assignee: Canon Kabushiki Kaisha, Tokyo, Japan

[21] Appl. No.: 08/674,847

[22] Filed: Jul. 3, 1996

Related U.S. Application Data

[63] Continuation of application No. 08/135,445, Oct. 13, 1993, abandoned.

[30] Foreign Application Priority Data

Oct. 15, 1992 [JP] Japan ..... 6-277163
Nov. 17, 1992 [JP] Japan ..... 8-306907

[51] Int. Cl.[6] ..... B41J 2/01

[52] U.S. Cl. ..... 347/14; 347/9; 347/19; 347/50; 347/58

[58] Field of Search ..... 347/14, 19, 9, 347/48, 49, 50, 56, 58, 189

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,567,353 | 1/1986 | Aiba | 219/501 |
| 4,608,577 | 8/1986 | Hori . | |
| 4,723,129 | 2/1988 | Endo et al. . | |
| 4,740,796 | 4/1988 | Endo et al. . | |
| 4,872,027 | 10/1989 | Burkik et al. | 347/19 |
| 5,144,341 | 9/1992 | El Haten et al. . | |
| 5,148,192 | 9/1992 | Izumida et al. . | |
| 5,208,611 | 5/1993 | Kappel et al. | 347/17 |
| 5,235,351 | 8/1993 | Koizumi | 347/14 |

FOREIGN PATENT DOCUMENTS

| | | | |
|---|---|---|---|
| 0376314 | 7/1990 | European Pat. Off. . | |
| 0419178 | 3/1991 | European Pat. Off. . | |
| 0435565 | 7/1991 | European Pat. Off. . | |
| 4020885 | 1/1992 | Germany . | |
| 56-56847 | 5/1979 | Japan . | |
| 59-123670 | 7/1984 | Japan . | |
| 59-138461 | 8/1984 | Japan . | |
| 60-71260 | 4/1985 | Japan . | |
| 4-214356 | 8/1992 | Japan | 347/14 |
| WO90/6852 | 6/1990 | WIPO . | |

*Primary Examiner*—N. Le
*Assistant Examiner*—Craig A. Hallacher
*Attorney, Agent, or Firm*—Fitzpatrick, Cella, Harper & Scinto

[57] ABSTRACT

A driving voltage of a discharging heater in an ink jet recording head is set according to property of the individual recording head. More specifically, sub-heaters are formed on a board on which discharging heaters are formed, by a same process as that for the discharging heaters. Resistance values of the sub-heaters are read so that the driving voltage of the discharging heaters can be set on the basis of the read resistance values.

17 Claims, 10 Drawing Sheets

INK JET RECORDING HEAD AND APPARATUS IN WHICH RECORDING IS CONTROLLED IN ACCORDANCE WITH CALCULATIONS INVOLVING A MEASURED RESISTANCE

This application is a continuation of Application No. 08/135,445 filed Oct. 13, 1993, now abandoned.

FIELD OF THE INVENTION

The present invention relates to an ink jet recording apparatus, and more particularly to a construction of an ink jet recording head including a resistor element, the resistor element generating thermal energy utilized for discharging ink.

DESCRIPTION OF PRIOR ART

In recent years, a replaceable recording head often has been used for an ink jet recording apparatus. The reason for this is that manufacturing cost of such replaceable recording head is relatively inexpensive and by the use of this low cost recording head, the ink jet recording apparatus may have a construction which enables a recording head unit of cartridge-type in which a recording head is integrated with an ink tank to be exchanged at a time when ink in the ink tank is completely consumed.

Incidentally, there often are variations, even slightly, among individual ink discharging characteristics of the replaceable recording heads. In particular, with regard to heating resistor elements for generating thermal energy utilized for discharging ink, variations produced in the manufacturing process thereof frequently result in variations among ink droplets discharged and the like.

Thus, in a conventional manufacturing process of recording head, generally, some processes as will be described in the following are included.

First, a process for measuring a threshold voltage $V_{th}$, that is, a lowest voltage of the heating resistor element at which ink discharge actually just occurs and a process for storing measured results as data into a memory circuit provided, for example, at a printed board of the recording head. Then, the stored data in this process are read out by means of a control portion of an ink jet recording apparatus on which the recording head is installed, and in response to the read out data the driving voltage of the heating resistor element can be set up.

Second, a process for stabilizing ink discharge of the recording head, more specifically, the process is that: before shipping of the recording head certain pulses of a driving voltage K times as much as the threshold driving voltage $V_{th}$ measured in the measuring process described above is applied a plurality of times to each of the heating resistor elements so as to stabilize ink discharging characteristic of the recording head.

However, with regard to the above-mentioned conventional process for setting up the driving voltage and that for discharge stabilizing processing, there have been problems as will be described in the following.

1) In order to set up the driving voltage, it is needed to newly provide the following two processes in the manufacturing process of the recording head, that is, a process for measuring a threshold voltage $V_{th}$, at which discharge of ink just occurs, while actually performing ink discharge and a process storing the measured data in the recording head. As a result, increases of both the number of manufacturing process and manufacturing cost associated therewith are brought about.

2) It becomes necessary to provide a circuit such as a ROM for storing the threshold driving voltage at which ink discharge just occurs, or a configuration to hold information signals corresponding to the threshold driving voltage in the recording head. Accordingly, in case of providing the circuit such as the ROM cost of the product increases and in case of holding the information signals in the recording head, it is needed to provide a plurality of terminal pads and the like for holding a plurality of signals therein so that problems relating to the increase of production cost and deterioration of reliability of contact portions are derived therefrom.

3) In case of measuring the minimum power at which discharge of ink just occurs, while varying applied voltage to measure the threshold voltage, it may be caused unstable ink discharge state due to, for example, dirt stuck to heating resistor elements so that the appropriate threshold electric power can be not always measured.

4) Since the discharge stabilizing processing is performed by applying the voltage K times as much as the threshold voltage $V_{th}$ measured to the respective heating resistor elements, in actual recording it may attain to a insufficiently stabilized discharge state even if certain pulses of an applied voltage less than K times as much as the threshold voltage are applied thereto. In such a case, deterioration of recording quality or the like may be caused.

On the other hand, a problem similar to that in the conventional process described above in the item 2) arises in a construction other than the construction in which a plurality of information signals are held in the recording head. For example, the problem arises in a case where heating resistor elements used for temperature control of the recording head are disposed thereto. This problem will be described below in detail with reference to FIGS. 1 and 2.

FIG. 1 is a schematic view showing a construction on a substrate 1101. On the substrate 1101, a plurality of, for example, 32 heating resistor elements (hereafter, a heating resistor element is referred to as a discharging heater), which correspond to a plurality of discharging orifices of the recording head, respectively, are arranged at near one end side thereof (portion near an upper end side in the figure) and a resistor element group 1107 is formed with those discharging heaters. Each of discharging heaters in the resistor element group 1107 is driven by a driver 1109 in accordance with a respective heater driving signal via matrix arrayed wiring 1108, whereby heat is applied to ink and discharge of the ink is performed. Resistor elements (hereafter, a resistor element is referred to as a sub-heater) 1103 and 1104 are disposed at near both side ends of the substrate 1101 (portions near each of left and right sides thereof in the figure), respectively, the resistor elements 1103 and 1104 being used for heating in the temperature control of the recording head.

A grounding terminal 1105, an input terminal 1106 for heater driving signal, and an electric power supply terminal 1110 are provided at near the other end side in the substrate 1101 (a portion near a lower end side thereof in the figure), and further are provided two terminals 1102*a*, 1102*a* for the sub-heater 1103 and two terminals 1102*b*, 1102*b* for the sub-heater 1104, respectively.

In the conventional recording head as described above, in a case that there are 20 leads between the substrate 1101 of the recording head and a printed wiring board 1303, 4 leads among them are to be used for the sub-heaters 1103 and 1104. Incidentally, in an ink jet recording apparatus as shown in FIG. 2, which includes the recording head having the construction described above, respective four contacting portions to be connected physically are connected in such a manner that: the contacting portion between the substrate 1101 and the printed wiring board 1303 is connected by bonding wires 1302; the contacting portion between the printed wiring board 1303 and a flexible plate (flexible cable) 1305 is connected by a pressure contacting portion 1304, and the flexible plate 1305 and a main electric component mounting plate 1307 of the recording apparatus is connected by pressure contacting using a connector 1306, respectively.

However, with regard to the conventional recording apparatus described above it becomes necessary to provide as many as four leads to detect respective resistance values of the sub-heater 1103 and 1104. Thus, there arise problems that as the number of leads to be drawn out from the substrate 1101 increases, cost for connecting portions of the recording apparatus having the construction as shown in FIG. 2 becomes more expensive and also the reliability of contacts thereof deteriorates therewith.

SUMMARY OF THE INVENTION

An object of the present invention is to provide a recording head and an ink jet recording apparatus using the recording head, by which it enables to dissolve the problems related to the set up of the driving voltage of the discharging heater and the discharge stabilizing processing as described above and at the same time to dissolve the deterioration of the reliability or the like which are derived from the dissolution of the above two problems.

Another object of the present invention is to provide an ink jet recording apparatus which enables to determine the driving electric power of a discharging resistor element on the basis of the resistance value of the other resistor element which is provided in the same process as the discharging resistor element as described above of a recording head installed on the ink jet recording apparatus.

Still another object of the present invention is to provide a recording head and an ink jet recording apparatus, in which by connecting one terminal of respective resistor elements included in a recording head to a grounding terminal of the recording head or an electric power supply terminal, the number of leads drawn out from the resistor elements can be reduced, whereby the improvement of the reliability of contact portions and the lowering of manufacturing cost thereof can be realized.

Still another object of the present invention is to provide a recording head and an ink jet recording apparatus in which the set up of the driving power of the discharging heater can be performed without actual discharge of ink which may be affected by dust on the discharging heater or the like.

In the first aspect of the present invention, there is provided an ink jet recording apparatus for performing recording by using a recording head for discharging ink so as to discharge ink on to a record medium, comprising:

a first resistor element being formed in the recording head, and provided for generating thermal energy which is used for discharging ink;

a second resistor element being formed in the recording head by a same process as a process for the first resistor element;

a wiring for connecting one terminal of the second resistor element to a ground terminal of the recording head or to a power supply terminal of the recording head, and connecting the other terminal of the resistor element to a detecting terminal of the recording head;

a setting means for reading a resistance value of the second resistor element through the ground terminal or the power supply terminal and the detecting terminal in responding to installation of the recording head on the ink jet recording apparatus, and for setting a driving power of the first resistor element on the basis of the read resistance value; and a driving means for supplying the driving power set by the setting means to the first resistor element so as to drive the first resistor element.

In the second aspect of the present invention, there is provided an ink jet recording apparatus for performing recording by using a recording head for discharging ink so as to discharge ink on to a record medium, comprising:

a first resistor element being formed in the recording head, and provided for generating thermal energy which is used for discharging ink;

a second resistor element being formed in the recording head by a same process as a process for the first resistor element;

a setting means for reading a resistance value of the second resistor element in responding to installation of the recording head on the ink jet recording apparatus, and for setting a driving power of the first resistor element on the basis of the read resistance value; and a driving means for supplying the driving power set by the setting means to the first resistor element so as to drive the first resistor element.

In the third aspect of the present invention, there is provided a recording head for discharging ink, comprising:

a first resistor element for generating thermal energy which is used for discharging ink; and a second resistor element which is formed by a same process as a process for the first resistor element, one terminal of the second resistor element being connected to a ground terminal or a power supply terminal of the recording head, the other terminal of the second resistor element being connected to a detecting terminal of the recording head, a resistance value of the second resistor element is read through the ground terminal or the power supply terminal and the detecting terminal in responding to installation of the recording head on an ink jet recording apparatus, and the read resistance value being used for setting driving power of the first resistor element.

In the fourth aspect of the present invention, there is provided a recording head for discharging ink, comprising:

a first resistor element for generating thermal energy which is used for discharging ink; and a second resistor element which is formed by a same process as a process for the first resistor element, a resistance value of the second resistor element is read in responding to installation of the recording head on an ink jet recording apparatus, and the read resistance value being used for setting driving power of the first resistor element.

In the fifth aspect of the present invention, there is provided a method for stabilizing a discharge state of a recording head for discharging ink, comprising the steps of:

manufacturing the recording head including a first resistor element for generating thermal energy which is used for discharging ink, and a second resistor element being formed by a process as a process for the first resistor element;

reading a resistance value of the second resistor element;

setting driving power of the first resistor element on the basis of the read resistance value; and supplying $10^t$ pluses each of which has power k times as much as the set driving power so as to discharge ink;

wherein, $1.0 \leqq k \leqq 1.8$ and $4 \leqq t \leqq 8$.

In the sixth aspect of the present invention, there is provided a recording head for discharging ink, comprising:

a first resistor element being formed in the recording head, and provided for generating thermal energy which is used for discharging ink;

a second resistor element being formed in the recording head distinctly from the first resistor element; and a wiring for connecting one terminal of the second resistor element to a ground terminal or a power supply terminal of the recording head, and for connecting the other terminal to a detecting terminal of the recording head.

In the seventh aspect of the present invention, there is provided an ink jet recording apparatus for performing recording by using recording head, the recording head comprising:

a first resistor element being formed in the recording head, and provided for generating thermal energy which is used for discharging ink;

a second resistor element being formed in the recording head distinctly from the first resistor element; and a wiring for connecting one terminal of the second resistor element of a ground terminal or a power supply terminal of the recording head, and for connecting the other terminal to a detecting terminal of the recording head.

The above and other objects, effects, features and advantages of the present invention will become more apparent from the following description of embodiments thereof taken in conjunction with the accompanying drawings.

DESCRIPTION OF PREFERRED EMBODIMENTS

Referring to the accompanying drawings, embodiments of the present invention will be described in more detail below.

Embodiment 1

Figure 3:
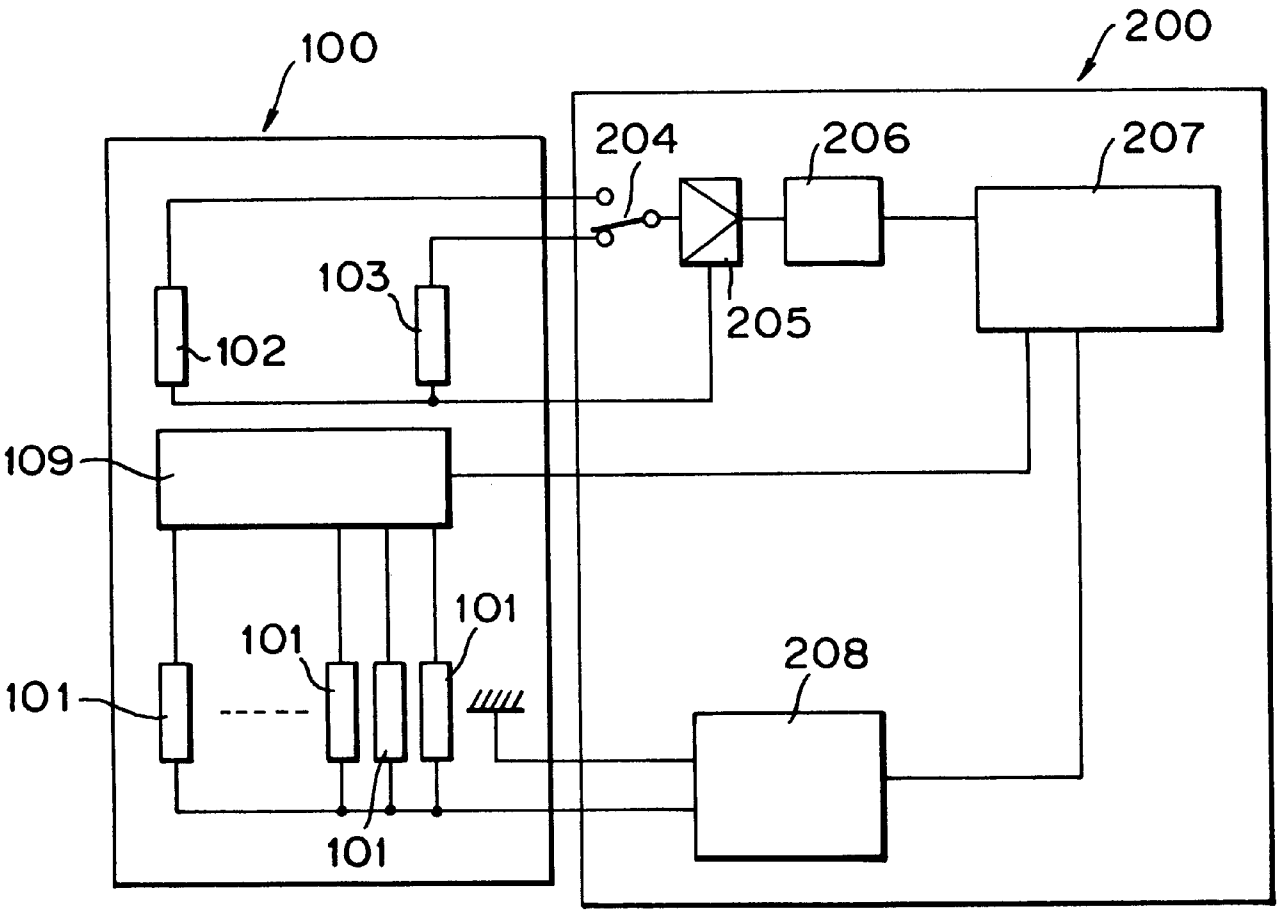
FIG. 3 is a block diagram showing a construction for driving heater according to an embodiment of the present invention.

FIG. 3 is a block diagram showing a structure for driving a heating resistance element in an ink-jet recording apparatus of an embodiment according to the present invention.

As shown in FIG. 3, on a substrate 100 of a recording head, a plurality of heating resistance elements 101 (referred to below as a discharging heater) for generating thermal energy are formed which correspond to a plurality of ink discharging orifices, respectively. Each of the plurality of heating resistance elements 101 is driven selectively by a driving circuit 109 on the basis of data on discharging.

On the substrate 100, two resistance elements 102 and 103 (referred to below as a detecting heater) are formed, which are formed by the same process as that for the discharging heater 101 and whose resistance values are measurable. As described later, these resistance values are read by an apparatus 200 according to the switching of a switch 204 of the apparatus 200.

In the apparatus 200, there are provided a DC amplifier 205 for amplifying a signal from the detecting heater 102 or 103 and an A/D converter 206 for analog-to-digital converting a signal from the DC amplifier. A logic circuit 207 determines the driving condition of the discharging heater 101 on the basis of a signal of a resistance value from the A/D converter 206. Reference numeral 208 denotes a power supply source for driving the discharging heater 101.

Figure 4:
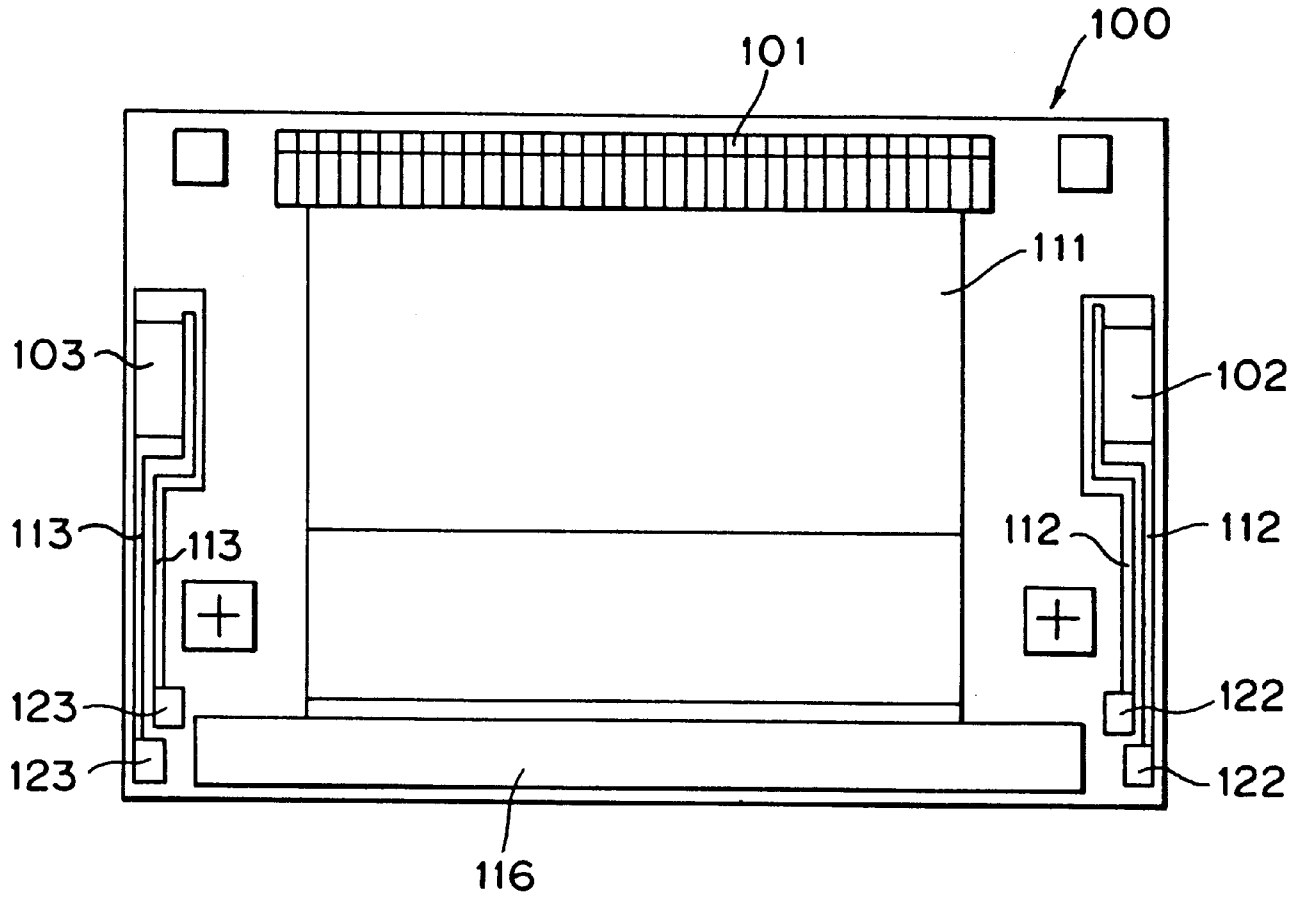
FIG. 4 is a schematic plan view showing an electric circuit on the substrate 100 shown in FIG. 3.

FIG. 4 is a schematic plan view showing a portion to which electric power is supplied in the substrate 100 of FIG. 3.

In FIG. 4, a matrix arranged wiring 111 is connected to the plurality of discharging heaters 101 to drive the plurality of the discharging heaters selectively on the basis of the data on discharging. A group of connecting pads 116 is connected to edge portions of the matrix wiring 111. Wires 112 and 113 for supplying electric power to the detecting heaters 102 and 103 are connected to the detecting heaters 102 and 103, respectively, and terminals 122, 122 and 123, 123 are connected to the edge portions of the wires 112 and 113, respectively.

Figure 5:
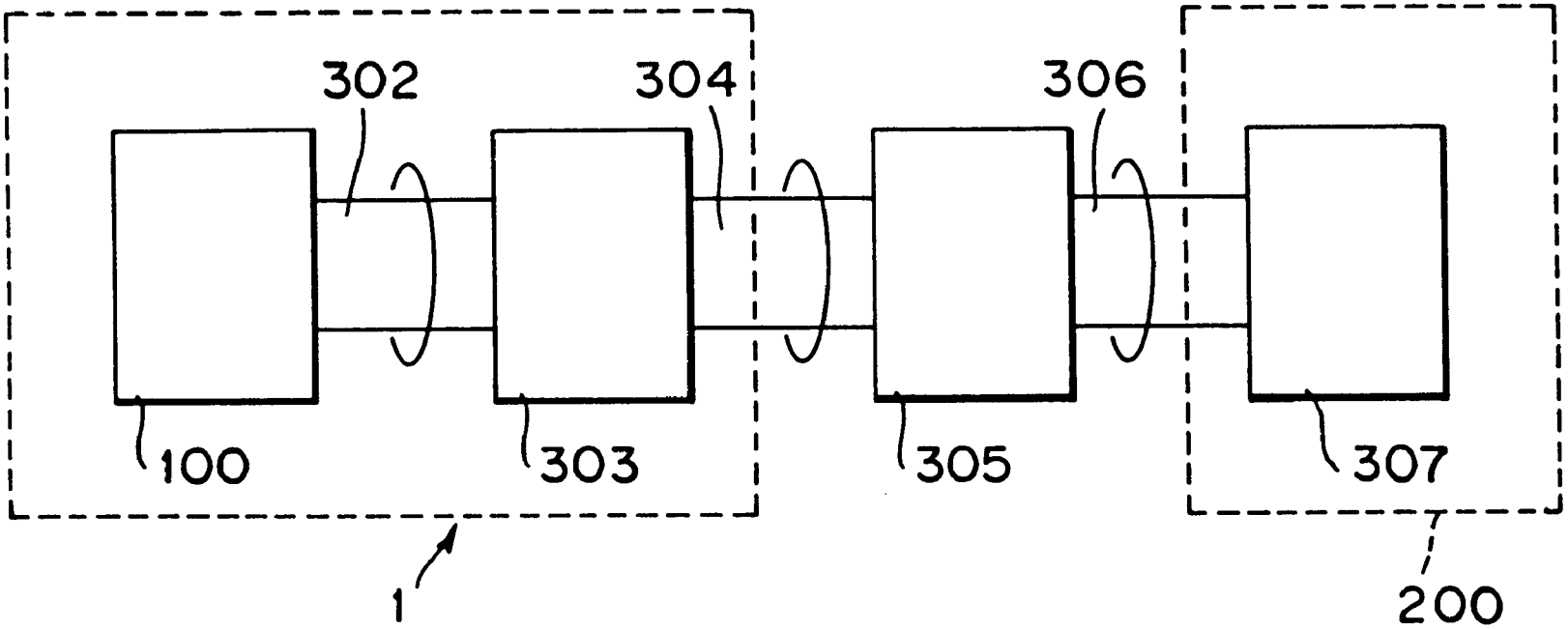
FIG. 5 is a block diagram showing an electric connection of a recording head in an ink jet recording apparatus according to an embodiment of the present invention.

FIG. 5 is a block diagram showing an electrical connection schematically when a recording head 1 is mounted on the ink-jet recording apparatus 200.

As shown in FIG. 5, the recording head 1 is connected to an electrical packaging substrate 307 via a flexible cable 305. The flexible cable 305 is connected to the electrical packaging substrate 307 through a connector 306, and the recording head 1 is connected to the flexible cable 305 through a connection under pressure. The electrical structure of the recording head 1 is composed of the substrate 100 and a printed circuit board 303 and the substrate 100 is connected to the printed circuit board 303 through wire bonding 302.

Setting of a heater driving voltage in the structure shown in FIGS. 3 to 5 will be described below.

When the recording head 1 is mounted on the recording apparatus 200, the logic circuit 207 reads the resistance values of the detecting heaters 102 and 103 in sequence in accordance with changeover of the switch 204. The reason for reading both of these resistance values is as follows. When the measurements of the substrate 100 are large, variation of the resistance value of the discharging heater 101 may become large. Thus, the variation is corrected to set an appropriate heater driving voltage. The logic circuit 207 sets the heater driving voltage according to a predetermined relationship between the read resistance values and the heater driving voltage, and these setting enables an applying this set driving voltage to the heater 101.

The relationship stated above is determined as follows:

First, assuming that the read resistance values and areas of the detecting heaters 102 and 103 are $R_{sub}$ [Ω] and $S_{sub}$ [$\mu m^2$] respectively, the resistance value of wire 113 of the detecting heater is $r_{sub}$ [Ω], the heater power for a unit area necessary for starting discharging ink by the discharging heater 101 is $P_H$ [J/$\mu m^2$], width and length of the heater 101 are W[$\mu$m] and l[$\mu$m] respectively, a resistance value of the wire 111 connected to the heater 101 is $r_H$[Ω], an applied threshold voltage necessary for starting discharging ink is $V_{th}$ [V] and pulse width of a driving pulse at this time is $P_W$ [s], the threshold voltage $V_{th}$ [V] is given by the following formula:

$$V_{th} = \sqrt{\frac{P_H \times W \times 1}{\left(\frac{R_{sub} - r_{sub}}{S_{sub}}\right) \times \frac{1}{W} \times Pw}} \times \left[\left(\frac{R_{sub} - r_{sub}}{S_{sub}}\right) \times W \times 1 + r_H\right]$$

Second, the driving voltage of the discharging heater 101 is set to a value 1.2 times as much as the threshold voltage $V_{th}$. The reason for setting these value is that durability against destruction caused by heating stress on the heater 101 and a margin for discharging ink are considered. That is, when a voltage larger than the above set voltage is applied to the heater 101, lifetime of the heater 101 is shortened compared with standard rating lifetime. To the contrary, when a voltage smaller than the above set voltage is applied to the heater 101, unstable discharge of ink such as non-discharge occurs and recording quality is deteriorated.

The above setting is performed on the basis of the resistance value Rsub of the detecting heater 102 and 103 read in the logic circuit of the recording apparatus 200 and the set driving voltage is applied to the discharging heater 101 via the power supply source 208.

The driving voltage in the discharge stabilizing processing to be performed before shipment of the recording head after it has been manufactured, is set similarly to the above.

The discharge stabilizing processing is performed in such manner that pulses with predetermined voltage number of which is of $10^4$ to $10^8$ is applied to each of discharging heaters 101 and then ink are discharged. By this process, discharged ink droplets can be uniformed, so that unevenness of density or the like is reduced and a stable high quality image can be recorded.

In the discharge stabilizing processing, the driving voltage $V_E$ [V] is obtained by multiplying the threshold value $V_{th}$ by 1.35, which is obtained by the above equation on the basis of resistance value $R_{sub}$ of the detecting heaters 102 and 103. That is, the driving voltage in the discharge stabilizing processing is given by equation $V_E=1.35 \cdot V_{th}$. However, the driving voltage is not limited to the above value. Even though the driving voltage is set to a value 1 to 1.8 times as much as the threshold voltage $V_{th}$ in the discharge stabilizing processing, the good discharge stabilizing processing can be obtained.

Additionally, the detecting heaters 102 and 103 may be provided so that the resistance value thereof is only read as described above, but may be a heater for heating the recording head or a resistance element for detecting temperatures used for controlling temperatures of the recording head. Furthermore, a resistance value of part of the discharging heater 101 may be read without separately providing the detecting heater for only reading the resistance value thereof as described above.

Moreover, in the above embodiment, depending on how to measure the resistance value, the resistance value of the detecting heater, which is read at when the recording head is mounted, may also include resistance values of a wire of the detecting heater and a driving IC. In this case, for example, a more correct driving voltage can be set by setting the threshold voltage $V_{th}$ on the basis of a resistance value obtained by subtracting the resistance value of the driving IC from the read resistance value of the detecting heater.

Furthermore, in the above each embodiment, an appropriate heater driving voltage is set on the basis of the read resistance value. But, the setting of the heater driving voltage is not limited thereto, and instead, pulse width may be set. In this case, the pulse width, in turn, becomes the function of the resistor value of the detecting heater and is calculated through a modified equation of the above stated equation.

In the above embodiments, the driving voltage is set on the basis of the measured resistance value of the detecting heater, whereby:

(1) The process for measuring and storing the threshold voltage $V_{th}$ can be removed from the manufacturing process.

(2) Since the recording head need not have a signal concerning information on the threshold driving voltage, information on the driving voltage can be obtained with small number of connecting terminals at the substrate.

(3) Reliability of contact portions can be improved by reducing the number of connecting terminals.

(4) In spite of other various causes, an appropriate driving power can be set to the recording head to perform recording with stable high image quality.

(5) Since the appropriate number of pulses of appropriate driving power can be applied which is suited to a different recording head on the basis of the resistance value of the detecting heater, a stable discharging state can be obtained.

Embodiment 2

The following embodiment 2 relates to the structure in which the number of connecting terminals on the substrate is further reduced to increase the reliability of contact portions, when the detecting heater is disposed on the recording head as described in the above embodiment 1. In addition, embodiment 2 may be applied not only to a recording head with a detecting heater provided but also to a recording head with a heating sub-heater for controlling temperatures of a recording head or a resistance element for detecting temperatures provided.

Figure 6:
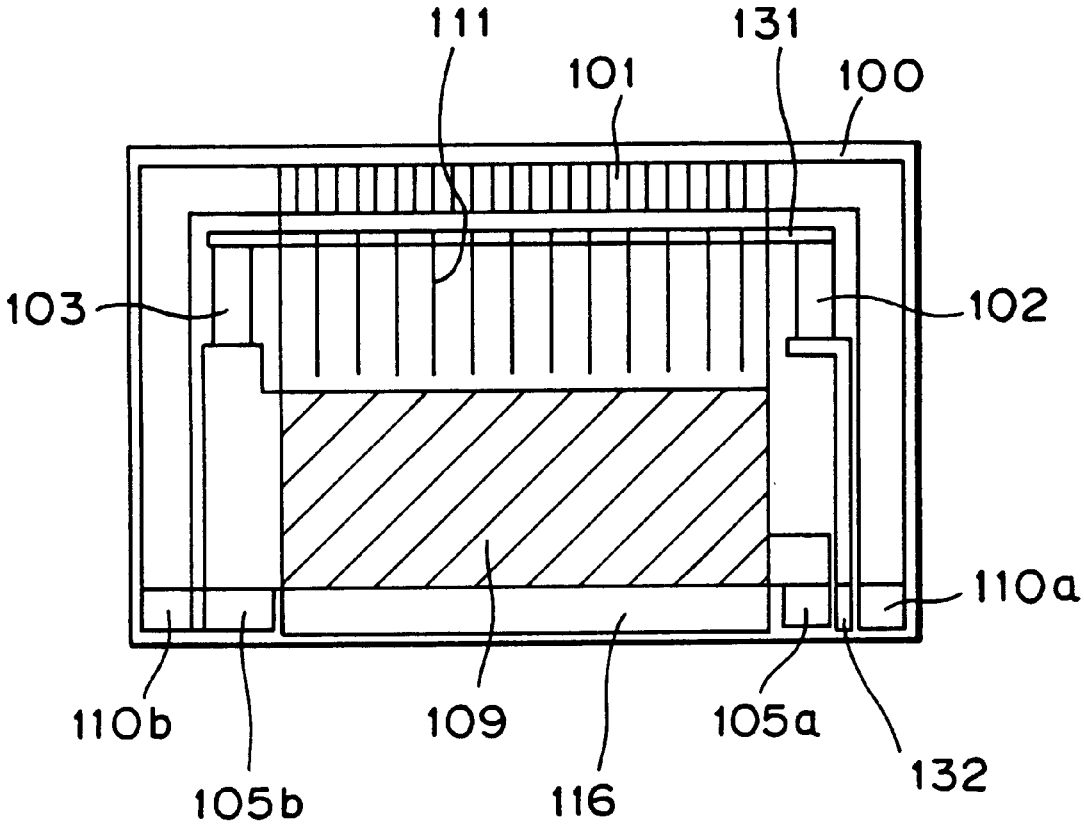
FIG. 6 is a plan view of a substrate for explaining another embodiment of a recording head according to the present invention.

FIG. 6 is an explanatory view for illustrating a schematic structure of layout on a silicon substrate 100 of a recording head of a second embodiment according to the present invention. On the substrate 100, there are provided the above stated detecting heaters 102 and 103, a discharging heater 101, a heater driver 109, a wire 108 connected between the discharging heater 101 and a heater driver 109 and a heater driving signal input pad 116. Moreover, ground terminals 105*a*, 105*b* and power supplying terminals 110*a*, 110*b* are formed in either edge portion of the substrate 100. One end of the detecting heater 102 is connected to a monitor terminal 132, one ends of detecting heaters 102 and 103 are connected to each other through the connecting portion 131, and the other end of the detecting heater 103 is connected to the ground terminal 105*b*.

Figure 7:
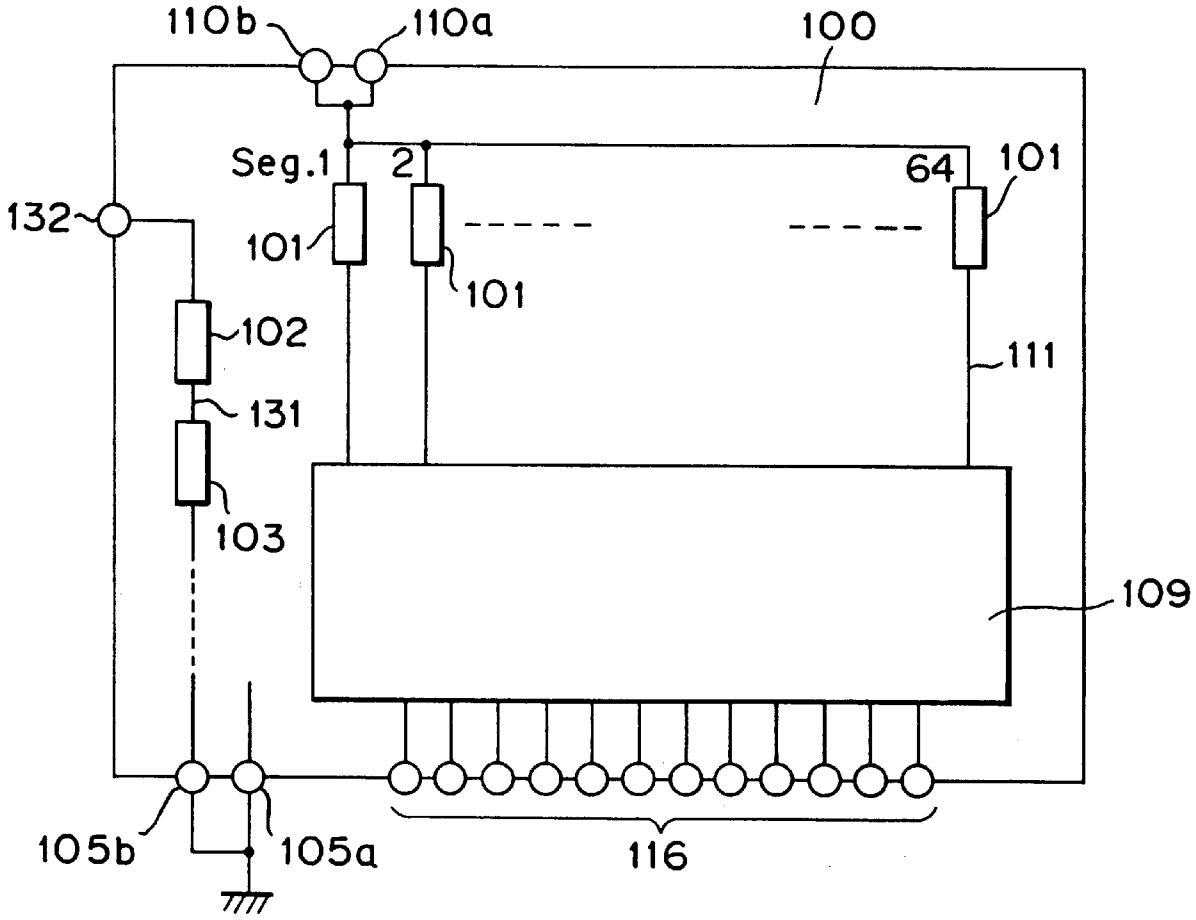
FIG. 7 is a block diagram of a circuit formed on the substrate shown in FIG. 6.

FIG. 7 is a block diagram of a circuit formed on the substrate 100 shown in FIG. 6. The detecting heaters 102 and 103 are connected in series between the monitor terminal 132 and the ground terminal 105*b*. Therefore, the change in a composite resistance of the detecting heaters 102 and 103 can be monitored between the terminals 132 and 105*b*. Providing a single wire connected to the monitor terminal 132 is enough to monitor the above change.

Instead of the detecting heater, when two resistance elements as temperature sensors are disposed in either edge portion of the silicon substrate 100 and are connected in series, average temperatures of either portion of the substrate 100 can be detected in consideration of variation in temperatures on the substrate 100. Moreover, when being disposed as a heating element, an active resistance element heats the substrate 100 so as to control the temperature of the substrate 100 appropriately.

Figure 1:
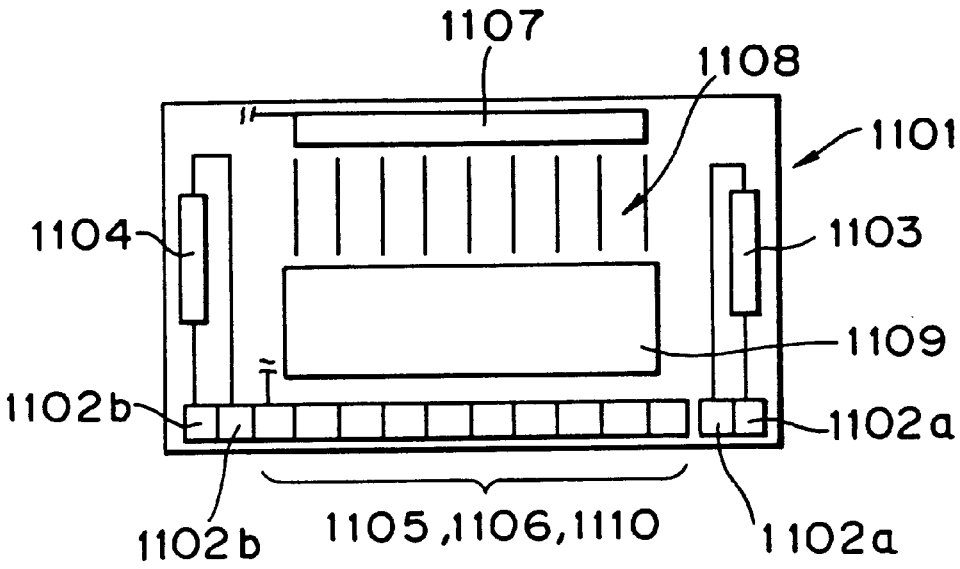
FIG. 1 (PRIOR ART)
FIG. 1 is a plan view of a substrate for explaining a conventional recording head.
Figure 2:
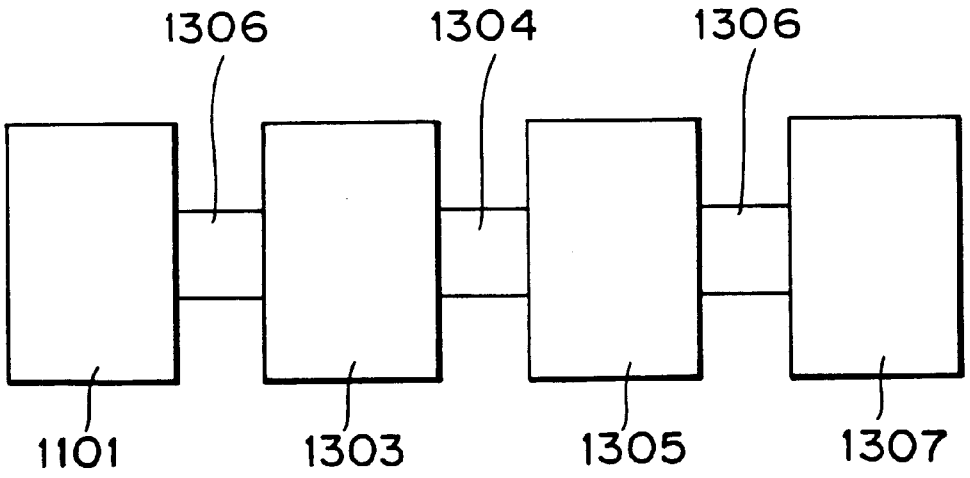
FIG. 2 (PRIOR ART)
FIG. 2 is a block diagram for explaining an electric connection arrangement of a recording head in a recording apparatus.

The effects of embodiment 2 are summarized as follows:

(1) As compared with the conventional example shown in FIG. 2, the number of wires of wire bonding for connecting a silicon substrate 1101 to a printed circuit board 1303, can be reduced by three.

(2) In FIG. 2, the number of pressure contact pads between the printed circuit board 1303 and a flexible cable 1305 can be reduced by three.

(3) In FIG. 2, since the number of the flexible cables 1305 is reduced by three, the production cost can be reduced according to the number of the flexible cables 1305.

(4) In FIG. 2, the number of terminals in connectors 1306 between the flexible cables 1305 and an electrical mounting substrate 1307 can be reduced by three.

For these reasons of the above items (1) to (4), besides the direct production cost of the recording apparatus can be reduced, the number of contact points can be reduced. As a result, reliability of connection portions can be improved.

Figure 8:
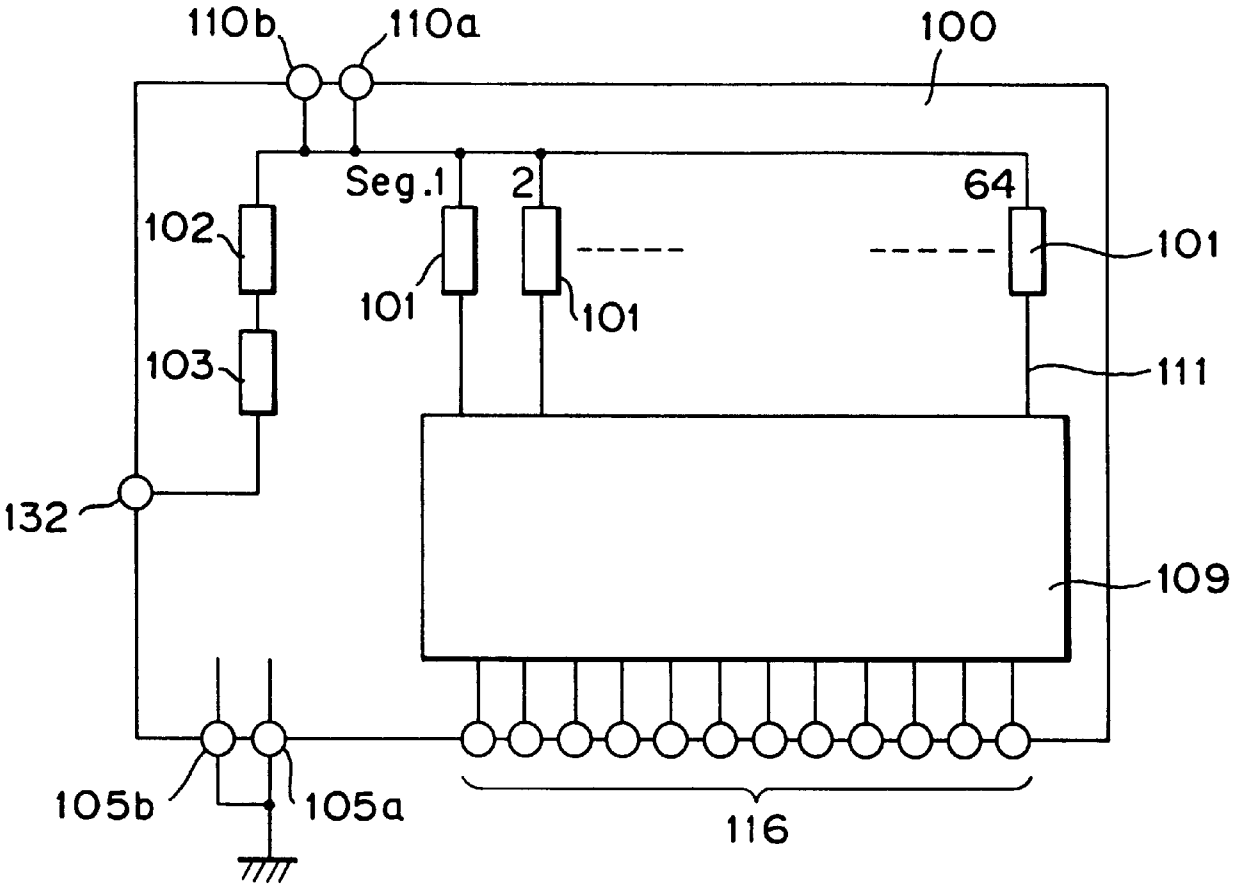
FIG. 8 is a plan view of a silicon substrate for explaining a modified example of the another embodiment described above.

FIG. 8 is a circuit block diagram for explaining a modification example of embodiment 2. In this example, detecting heaters 102 and 103 are connected in serial between the monitor terminal 132 and the power supply terminal 110*b*. Therefore, in this example, a composite resistance formed by connecting the detecting heaters 102 and 103 in serial between the terminals 132 and 110*b*, can be monitored.

Figure 9:
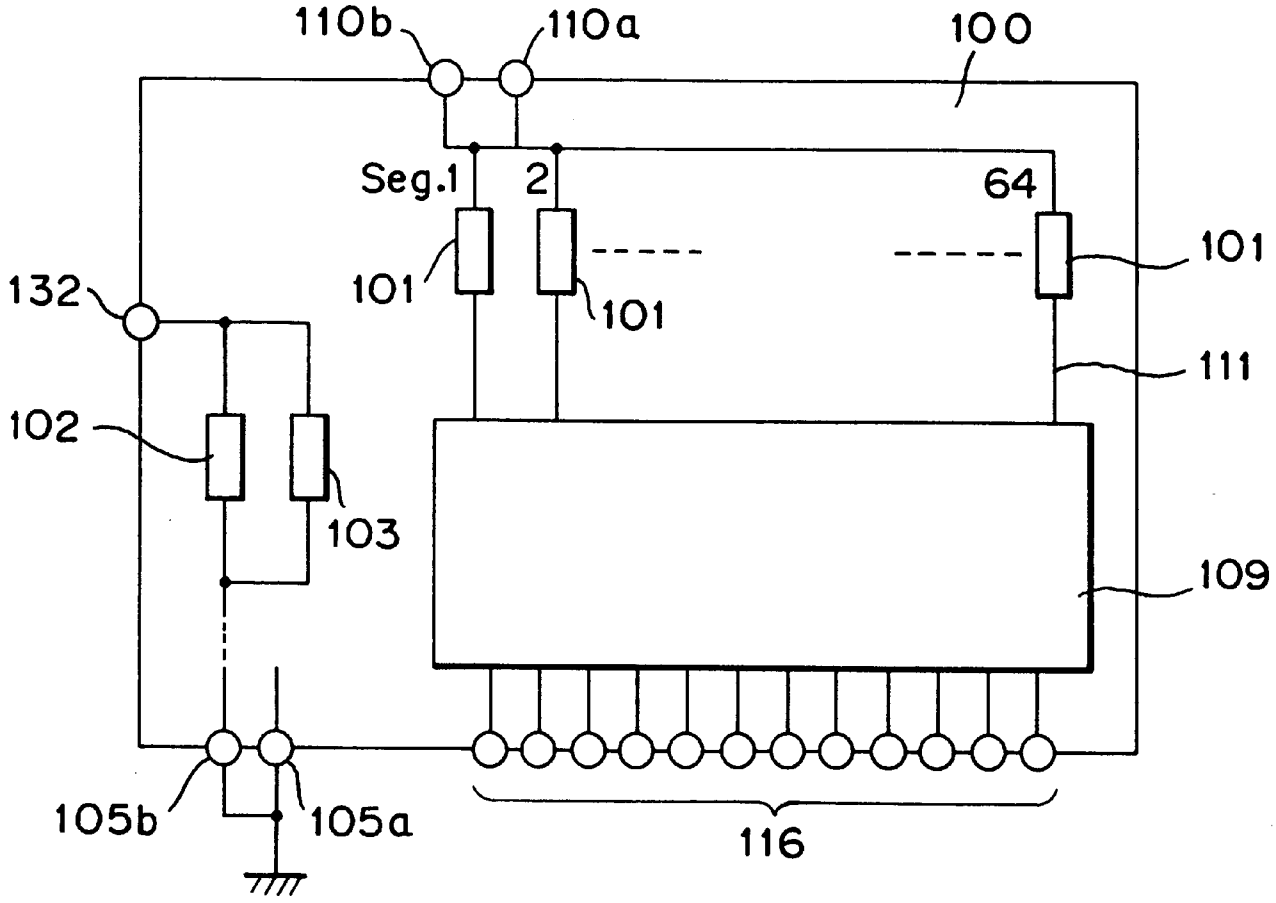
FIG. 9 is a plan view of a silicon substrate for explaining another modified example of the another embodiment described above.

FIG. 9 is a circuit block diagram for explaining another modification example of embodiment 2. In this example, detecting heaters 102 and 103 are connected in parallel between the monitor terminal 132 and the ground terminal 105*b*. Therefore, in this example, a composite resistance formed by connecting the detecting heaters 102 and 103 in parallel between the terminals 132 and 105*b*, can be monitored.

Figure 10:
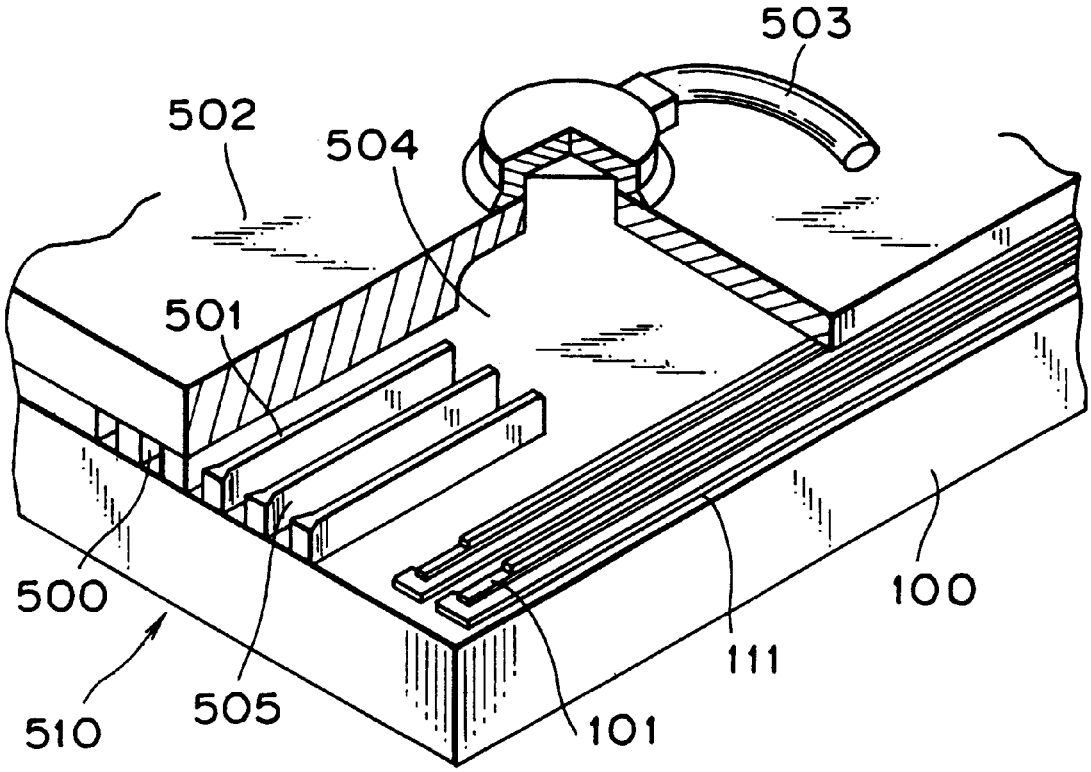
FIG. 10 is a partial cutaway perspective view for explaining a construction example of a discharging orifice portion of a recording head to which the embodiment of the present invention is applicable.

FIG. 10 is a partially cut away perspective view for showing a structure of a discharging portion of the recording head to which the above each embodiment can be applied.

In FIG. 10, a recording head 510 has a structure in which a head chip and an ink storage portion are formed integrally. The head chip has a junction structure of a silicon substrate 100 and a glass or resinous top plate 504 and a plurality of discharging orifices 500 are formed in line on a discharging surface side in the junction portion. The plurality of discharging orifices 500 communicate with a common liquid chamber (liquid chamber) 504 via a plurality of liquid paths 505, respectively. A partition 501 between the two liquid paths 505 is formed by ultraviolet setting resin etc., for example. The common liquid chamber 504 communicates with the ink storage portion via a tube 503.

On an upper surface of the substrate 100, a discharging heater 101 as a heat energy generating element which is disposed in each of the plurality of liquid paths 505 and a wire 111 made of aluminum etc. for supplying electric power to each discharging heater 101 are formed using the film-forming technique. The above described detecting heaters 102 and 103 are also disposed on the substrate 100.

Figure 11:
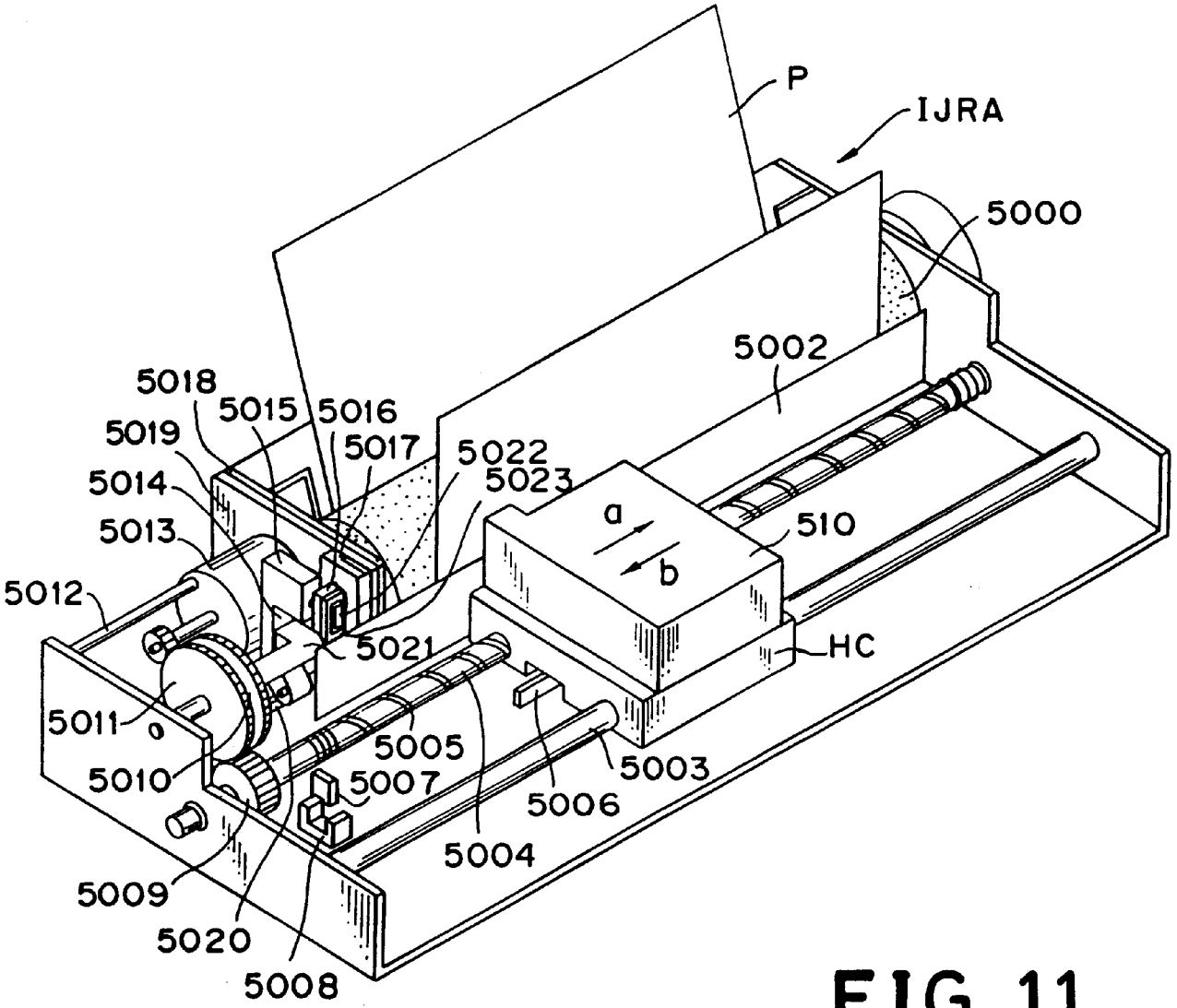
FIG. 11 is a perspective view for explaining a construction example of a recording apparatus to which the embodiment of the present invention is applicable.

FIG. 11 is a schematic view of an ink-jet recording apparatus IJRA with the above recording head 510 provided.

In FIG. 11, a lead screw 5005 turns in the forward or reverse direction with the forward or reverse turn of a driving motor 5013 via driving power transmission gears 5011 and 5009. A carriage HC having a pin (not shown) engaged with a spiral groove 5004 is reciprocated in the directions shown by arrows a and b. A recording head 510 is mounted on the carriage HC. Reference numeral 5002 denotes a sheet pressure plate which presses paper P against a platen 5000 over the moving range of the carriage HC. Reference numerals 5007 and 5008 denote photo-couplers, or detecting means for detecting a home position, which confirm presence of a lever of the carriage HC so as to switch the rotational direction of the motor 5013. Reference numeral 5016 denotes a member for supporting a cap member 5022 which caps a front surface of the recording head 510. Reference numeral 5015 denotes suction means for sucking the inside of the cap member 5022, which performs suction recovery of the recording head 510 via an opening 5023 of the cap member 5022. Reference numerals 5017 and 5019 denote a cleaning blade and a member which enables the cleaning blade to move forward and backward, and they are supported by an apparatus supporting plate 5018. With the cleaning blade 5017, it is needless to say that a well known cleaning blade other than the above cleaning blade can be applied to this embodiment. Moreover, reference numeral 5012 denotes a lever, which moves with movement of a cam 5020 engaged with the carriage HC, and the driving force transmitted from the driving motor 5013 is moved and controlled by well known transmission means such as clutch switchover means.

These capping, cleaning and suction recovery actions are constructed so that these actions can perform desired processing at the corresponding positions by an action of the lead screw 5005 when the carriage HC arrives at the home position area. When the desired operation is performed in well known timing, these capping, cleaning and suction recovery actions are applicable to any one of the embodiments of the present invention. The above each structure is a superior invention from a viewpoint of a single structure and combined structures and shows a preferable structural embodiment.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus for performing recording with a recording head for discharging ink so as to discharge ink on to a record medium, comprising:

a first resistor element formed in said recording head by a forming process, and provided for generating thermal energy which causes a discharge of ink;

a second resistor element formed in said recording head by the forming process;

a reading means for reading a resistance value of said second resistor element as a consequence of installation of said recording head on said ink jet recording apparatus;

setting means for calculating a resistance value of said first resistor element based on said resistance value read by said reading means and for setting a driving power based on said resistance value calculated; and a driving means for supplying the driving power set by said setting means to said first resistor element so as to drive said first resistor element.

2. An ink jet recording apparatus as claimed in claim 1, wherein said second resistor element comprises a pair of terminals, and one of said pair of terminals is connected to a ground terminal of said recording head or to a power supply terminal of said recording head.

3. An ink jet recording apparatus as claimed in claim 1, wherein said setting of said driving power is performed by setting a voltage of a pulse which is supplied to said first resistor element.

4. An ink jet recording apparatus as claimed in claim 1, wherein said setting of said driving power is performed by setting a width of a pulse which is supplied to said first resistor element.

5. An ink jet recording apparatus as claimed in claim 1, wherein said second resistor element serves to detect a temperature of said recording head.

6. An ink jet recording apparatus as claimed in claim 1, wherein said second resistor element heats said recording head.

7. An ink jet recording apparatus as claimed in claim 1, wherein said second resistor element is a part of a plurality of said first resistor elements.

8. A recording head for discharging ink, comprising:

a substrate;

a first resistor element disposed on said substrate for generating thermal energy which causes a discharge of ink, said first resistor element being formed by a forming process; and a second resistor element disposed on said substrate and which is formed by the forming process, wherein a resistance value of said second resistor element is read by a means for reading of an ink let recording apparatus as a consequence of installation of said recording head on the ink jet recording apparatus, a resistance value of said first resistor element is calculated by a means for calculating of the ink let recording apparatus based on said resistance value of said second resistor element which is read by said means for reading, and a driving power is set by a means of the ink jet recording apparatus for setting based on said resistance value of said first resistor element which is calculated.

9. A recording head as claimed in claim 8, wherein said second resistor element comprises a pair of terminals, and one of said pair of terminals is connected to a ground terminal of said recording head or to a power supply terminal of said recording head.

10. A method for stabilizing a discharge state of a recording head for discharging ink, comprising the steps of:

providing the recording head, which includes a first resistor element for generating thermal energy which causes a discharge of ink, and a second resistor element, using a same forming process to form said first and second resistor elements;

reading a resistance value of said second resistor element;

setting a driving power with which said first resistor element is driven by calculating said driving power based on said read resistance value; and supplying $10^t$ pulses each of which has power k times as much as said set driving power so as to discharge ink;

wherein, $1.0 \leqq k \leqq 1.8$ and $4 \leqq t \leqq 8$.

11. A recording head for discharging ink, comprising:

a first resistor element formed in said recording head, and provided for generating thermal energy which causes a discharge of ink;

a second resistor element formed in said recording head distinctly from said first resistor element, and comprising a pair of terminals, a resistance value of said second resistor element being readable by a means for reading of an ink jet recording apparatus which uses said recording head for monitoring a temperature of said recording head;

a pair of wirings respectively connected to the pair of terminals of said second resistor element;

a ground terminal; and a power supply terminal, wherein one of said pair of wirings connects one of said pair of terminals of said second resistor element to one of said ground terminal and said power supply terminal, and wherein the one of said pair of terminals that is so connected functions as a terminal for monitoring the temperature of said recording head.

12. A recording head as claimed in claim 11, wherein a plurality of said second resistor elements are connected to each other in serial or parallel.

13. A recording head as claimed in claim 12, wherein said second resistor element heats said recording head.

14. A recording head as claimed in claim 12, wherein said second resistor element serves to detect a temperature of said recording head.

15. An ink jet recording apparatus for performing recording by using a recording head, said recording head comprising:

a first resistor element formed in said recording head, and provided for generating thermal energy which causes a discharge of ink;

a second resistor element formed in said recording head distinctly from said first resistor element, and comprising a pair of terminals, a resistance value of said second resistor element being readable by a means of reading of said ink jet recording apparatus for monitoring a temperature of said recording head;

a pair of wirings respectively connected to the pair of terminals of said second resistor element;

a ground terminal; and a power supply terminal, wherein one of said pair of wirings connects one of said pair of terminals of said second resistor element to one of said ground terminal and said power supply terminal, and wherein the one of said pair of terminals that is so connected functions as a terminal for monitoring the temperature of said recording head.

16. A recording head for discharging ink, comprising:

a first resistor element formed in said recording head, and provided for generating thermal energy which causes a discharge of ink;

a second resistor element formed in said recording head distinctly from said first resistor element, and comprising a pair of terminals, a resistance value of said second resistor element being readable by a means for reading of an ink jet recording apparatus which uses said recording head and being used for setting a driving power of said recording head;

a pair of wirings respectively connected to the pair of terminals of said second resistor element;

a ground terminal; and a power supply terminal, wherein one of said pair of wirings connects one of said pair of terminals of said second resistor element to one of said ground terminal and said power supply terminal, and wherein the one of said pair of terminals that is so connected functions as a terminal for setting the driving power of said recording head.

17. An ink jet recording apparatus for performing recording by using a recording head, said recording head comprising:

a first resistor element formed in said recording head, and provided for generating thermal energy which causes a discharge of ink;

a second resistor element formed in said recording head distinctly from said first resistor element, and comprising a pair of terminals, a resistance value of said second resistor element being readable by a means for reading of said ink jet recording apparatus and being used for setting a driving power of said recording head;

a pair of wirings respectively connected to the pair of terminals of said second resistor element;

a ground terminal; and a power supply terminal, wherein one of said pair of wirings connects one of said pair of terminals of said second resistor element to one of said ground terminal and said power supply terminal, and wherein the one of said pair of terminals that is so connected functions as a terminal for setting the driving power of said recording head.

* * * * *

UNITED STATES PATENT AND TRADEMARK OFFICE

CERTIFICATE OF CORRECTION

PATENT NO. : 5,943,069

DATED : August 24, 1999

INVENTOR(S) : YUJI KAMIYAMA ET AL.

It is certified that error appears in the above-identified patent and that said Letters Patent is hereby corrected as shown below:

On the title page:

AT [30] FOREIGN APPLICATION PRIORITY DATA

"6-277163" should read --4-277163-- and
"8-306907" should read --4-306907--.

AT [56] REFERENCES CITED

U.S. PATENT DOCUMENTS

"Burkik et al." should read --Buskirk et al.--.

AT [56] REFERENCES CITED

FOREIGN PATENT DOCUMENTS

"56-56847" should read --54-56847--.

COLUMN 7

Line 3, "these" should read --this-- and "an" should be deleted.

UNITED STATES PATENT AND TRADEMARK OFFICE

CERTIFICATE OF CORRECTION

PATENT NO. : 5,943,069

DATED : August 24, 1999

INVENTOR(S) : YUJI KAMIYAMA ET AL.

It is certified that error appears in the above-identified patent and that said Letters Patent is hereby corrected as shown below:

COLUMN 14

Line 26, "of" should read --for--.

Signed and Sealed this

Twenty-seventh Day of June, 2000

*Attest:*

Q. TODD DICKINSON

*Attesting Officer*

*Director of Patents and Trademarks*